US010974295B2

(12) United States Patent
Hedvall et al.

(10) Patent No.: US 10,974,295 B2
(45) **Date of Patent: *Apr. 13, 2021**

(54) COLD PILGER ROLLING MILL AND METHOD FOR PRODUCING A PIPE

(71) Applicant: Sandvik Materials Technology Deutschland GmbH, Düsseldorf (DE)

(72) Inventors: Christofer Hedvall, Bielefeld (DE); Udo Rauffmann, Werther (DE); Thomas Froböse, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 252 days.

This patent is subject to a terminal disclaimer.

(21) Appl. No.: 16/089,427

(22) PCT Filed: Mar. 28, 2017

(86) PCT No.: PCT/EP2017/057312
§ 371 (c)(1),
(2) Date: Sep. 28, 2018

(87) PCT Pub. No.: WO2017/167750
PCT Pub. Date: Oct. 5, 2017

(65) Prior Publication Data

US 2019/0151916 A1 May 23, 2019

(30) Foreign Application Priority Data

Apr. 1, 2016 (DE) ..... 10 2016 106 035.6

(51) Int. Cl.
*B21B 21/00* (2006.01)
*B21C 47/18* (2006.01)
(Continued)

(52) U.S. Cl.
CPC ..... *B21B 21/005* (2013.01); *B21B 21/045* (2013.01); *B21B 21/065* (2013.01); *B21C 47/18* (2013.01); *B21B 2015/0064* (2013.01)

(58) Field of Classification Search
CPC ..... B21B 21/00; B21B 21/005; B21B 21/02; B21B 21/04; B21B 21/045; B21B 21/06;
(Continued)

(56) References Cited

U.S. PATENT DOCUMENTS 4,203,309 A 5/1980 Ermakov et al.
5,392,623 A * 2/1995 Cueman ..... B21B 21/005 72/11.2
(Continued)

FOREIGN PATENT DOCUMENTS

CN 101700529 A 5/2010
DE 2922941 A1 * 12/1980 ..... F27B 5/10
(Continued)

OTHER PUBLICATIONS

International Search Report and Written Opinion dated Jun. 6, 2017 issued in corresponding International Patent Application No. PCT/EP2017/057312.
(Continued)

*Primary Examiner* — Teresa M Ekiert
*Assistant Examiner* — Sarkis A Aktavoukian
(74) *Attorney, Agent, or Firm* — Morgan, Lewis & Bockius LLP

(57) ABSTRACT

Cold pilger rolling mill for cold forming a hollow into a strain hardened tube with a roll stand with rollers mounted pivotably thereon. Efficient milling of long hollows is enabled without reducing the quality of the manufactured tubes. The cold pilger rolling mill has an unwinding device, wherein the unwinding device is arranged and in the feed direction of the hollow is located in front of the front
(Continued)

mandrel thrust block such that at the unwinding device a spindle being rotatable around an axis being perpendicular to the feed direction of the hollow with the hollow wound thereon is receivable and in an operation of the cold pilger rolling mill the hollow is unwindable and feedable between the chuck of the front mandrel thrust block and the mandrel bar into the feed clamping sledge and the roll stand.

16 Claims, 3 Drawing Sheets

(51) Int. Cl.
*B21B 21/04* (2006.01)
*B21B 21/06* (2006.01)
*B21B 15/00* (2006.01)

(58) Field of Classification Search
CPC ..... B21B 21/065; B21B 25/02; B21B 25/00; B21B 17/02; B21B 17/04; B21B 17/08; B21C 47/16; B21C 47/18; B21C 47/22
See application file for complete search history.

(56) References Cited

U.S. PATENT DOCUMENTS

| | | | | |
|---|---|---|---|---|
| 5,916,320 | A * | 6/1999 | Stinnertz | B21B 21/005 72/208 |
| 6,360,575 | B1 * | 3/2002 | Zavodchikov | B21B 21/02 72/208 |
| 9,233,406 | B2 | 1/2016 | Froböse et al. | |
| 2009/0064749 | A1 * | 3/2009 | Hidaka | C22C 38/58 72/208 |
| 2012/0125066 | A1 | 5/2012 | Frobose | |
| 2012/0139195 | A1 * | 6/2012 | Froböse | B23B 13/125 279/123 |
| 2012/0272706 | A1 * | 11/2012 | Froböse | B21C 47/04 72/206 |
| 2013/0186214 | A1 * | 7/2013 | Froböse | F16H 21/22 74/44 |
| 2015/0258590 | A1 | 9/2015 | Rauffmann et al. | |

FOREIGN PATENT DOCUMENTS

| | | | | |
|---|---|---|---|---|
| DE | 4332136 | A1 | 3/1995 | |
| DE | 43 42 858 | A1 | 6/1995 | |
| DE | 10 2009 045 640 | A1 | 4/2011 | |
| DE | 102013105628 | A1 * | 12/2014 | F27B 5/10 |
| DE | 102014100107 | A1 * | 7/2015 | B21B 17/02 |
| GB | 2179283 | A * | 3/1987 | |
| JP | S56-075554 | A | 6/1981 | |
| JP | S58-090303 | A | 5/1983 | |
| JP | S58-156283 | A | 9/1983 | |
| JP | S62-130704 | A | 6/1987 | |
| JP | H04-197525 | A | 7/1992 | |
| JP | H04197525 | A * | 7/1992 | B02C 18/2283 |
| JP | H07-185608 | A | 7/1995 | |
| JP | 2015-532891 | A | 11/2015 | |

OTHER PUBLICATIONS

Goto et al., "Assessment of the Strength and the Toughness of Tool Materials for Metal Forming". University of Fukui School of Engineering Research Report. vol. 38, No. 1, Mar. 1990, pp. 1-8. (with partial translation).
Office Action dated Dec. 22, 2020, issued in corresponding Japanese Patent Application No. 2018-551095.
Office Action issued in corresponding European Patent Application No. 17713954.0, dated Jan. 29, 2021.

* cited by examiner

COLD PILGER ROLLING MILL AND METHOD FOR PRODUCING A PIPE

The present invention relates to a cold pilger rolling mill for cold forming of a hollow into a strain hardened tube with a roll stand having rollers rotatably mounted thereon, wherein the roll stand is motor driven moveable back and forth in a direction parallel to the longitudinal axis of the hollow between in a feed direction of the hollow a front point of return of the hollow and in the feed direction of the hollow a rear point of return, wherein the rollers during the motion of the roll stand back and forth carry out a rotating motion such that the rollers in operation of the cold pilger rolling mill the hollow into a tube, a mandrel, wherein the mandrel is mounted by a mandrel bar at a rear end of the mandrel bar in the feed direction of the hollow, such that during operation of the cold pilger rolling mill the hollow is milled by the rollers over the mandrel, at least one feed clamping sledge with a feed chuck mounted thereon to receive the hollow, wherein the fee clamping sledge is moveable back and forth in a direction parallel to the longitudinal axis of the hollow between in the feed direction of the hollow a front point of return and in the feed direction of the hollow a rear point of return such that the hollow during operation of the cold pilger rolling mill experiences a stepwise infeed in a direction towards the mandrel, wherein the feed chuck is openable and closeable in a radial direction such that the feed chuck releases or clamps the hollow, and with at least one mandrel thrust block with a chuck for mounting the mandrel bar, wherein a front mandrel thrust block in the feed direction of the hollow is located in front of the feed clamping sledge such that the mandrel bar in an operation of the cold pilger rolling mill is mountable by the chuck of the front mandrel thrust block, wherein the chuck of the front mandrel thrust block is openable in a radial direction such that a hollow is feedable between the chuck and the mandrel bar.

Furthermore, the present invention relates to a method for manufacturing a tube by cold forming of a hollow in a cold pilger rolling mill with a roll stand with rollers rotatably mounted thereon, a mandrel mounted by a mandrel bar, at least one mandrel thrust block mounting the mandrel bar and at least one feed clamping sledge with a feed chuck to receive the hollow with the steps:

a) opening the chuck of an in the feed direction of the hollow front mandrel thrust block in a radial direction and feeding a first hollow through the front mandrel thrust block,
b) feeding the first hollow to the feed clamping sledge and receiving the first hollow by opening the feed chuck in a radial direction and clamping the first hollow by closing the feed chuck in a radial direction at an in the feed direction of the hollow front point of return of the feed clamping sledge,
c) after entirely feeding the first hollow through the front mandrel thrust block closing the chuck of the front mandrel thrust block in a radial direction such that the front mandrel thrust block mounts the mandrel bar carrying the mandrel,
d) rolling the first hollow by the rollers over the mandrel into a strain hardened tube by stepwise feeding the first hollow by means of the feed clamping sledge and oscillatorily moving of the roll stand back and forth between a front point of return and a rear point of return of the rollers.

To manufacture precise metal tubes, in particular of steel, an elongated hollow cylindrical blank typically in an entirely cooled down state is cold reduced by compression stresses. Thereby the hollow is formed into a tube with a defined reduced outer diameter and a defined wall thickness.

The most wide spread method for reducing of tubes is known as cold pilger milling, wherein the blank is denoted as a hollow. The hollow during milling is pushed over a calibrated mandrel, i.e. comprising the inner diameter of the finished tube, and thereby is milled by two calibrated, i.e. defining an outer diameter of the finished tube, rollers and is milled in a longitudinal direction over the mandrel.

During the cold pilger milling the hollow experiences a stepwise infeed in a direction towards the mandrel, or over the mandrel, while the rollers are rotatably moved horizontally back and forth over the mandrel and thus over the hollow. In the process the horizontal motion of the rollers is caused by a roll stand, wherein the rollers are rotatably mounted at the roll stand. The roll stand in cold pilger mills is moved back and forth in a direction parallel to the mandrel by means of a crank mechanism while the rollers experience a rotating motion by a tooth bar being fixed relatively to the roll stand, wherein gear wheels fixedly mounted on the axis of the rollers engage with the tooth bar.

The infeed of the hollow over the mandrel is caused by means of a feed clamping sledge, which enables a translational motion in a direction parallel to the axis of the mandrel.

In the beginning of the milling process the hollow is loaded into the chuck of the feed clamping sledge by means of a loader comprising rolls. At the in the feed direction of the hollow front point of return of the roll stand, which is also denoted as the infeed dead point, the rollers reach an angular position in which the hollow can be received in a so called infeed pocket of the rollers and between the rollers. Accordingly calibrated rollers located above each other in the roll stand mill the hollow by rolling on the hollow in the feed direction of the feed clamping sledge back and forth. Therein the pair of rollers during a milling swing of the roll stand moves by a distance L from the in the feed direction of the hollow front point of return to the rear point of return of the roll stand, which is also denoted as the discharge dead center, and stretches the hollow over the mandrel mounted inside the hollow.

The rollers and the mandrel are calibrated such that the gap between the roller and the mandrel in the zone of the working caliber of the rollers continuously is reduced from the wall thickness of the hollow to the wall thickness of the finished milled tube. Furthermore, the outer diameter defined by the rollers is reduced from the outer diameter of the hollow to the outer diameter of the finished tube and the inner diameter defined by the mandrel is reduced from the inner diameter of the hollow to the inner diameter of the tube. In the adjacent zone of the planing caliber of the rollers no reduction in wall thickness of the tube to be manufactured is caused any longer, but just a planing of the surface of the tube to be manufactured. Once the discharge dead center is reached the readily milled tube is released by the discharge pockets of the rollers.

An infeed of the hollow between the rollers is caused either at the front point of return only or at the front as well as the rear point of return of the roll stand. By multiply milling each tube section, i.e. by infeed steps, being substantially smaller than the path length of the roll stand between the front and the rear point of return a homogenous wall thickness and roundness of the tube, a high surface quality of the tube as well as homogenous inner and outer diameters can be reached.

In order to obtain a homogenous shape of the finished tube, in addition to a stepwise infeed the hollow experiences an intermittent rotation around its axis. Rotation of the hollow occurs at both points of return of the roll stand, i.e. when the hollow is released by the infeed and discharge pockets of the rollers.

In the prior art cold pilger rolling mills are known, which can handle hollows with a length of up to about 15 m. If, however, tubes with a high quality, i.e. a homogenous wall thickness as well as a high surface quality of the inner and outer surface are needed with a length beyond 150 m these tubes cannot be manufactured with a cold pilger rolling mill according to the prior art. A manufacture of integrally formed tubes with a length of more than 150 m in a cold pilger mill requires a cold forming of hollows whose length exceeds the length of hollows, which can be manufactured with conventional mills significantly.

When compared to the prior art it is thus an object of the present invention to provide a device and a method which enable cold milling of hollows with a length of 30 m or more. A further object of the present invention relates to a space saving working of hollows with the length of 30 m or more such that long tubes with a high quality can be manufactured in a cold pilger mill and thus to an avoidance of high costs due to the necessity of large workshops. A further object of the present invention is a possibly efficient milling of long hollows without reducing the quality of the tubes to be manufactured.

At least one of the above objects is solved by a cold pilger rolling mill for cold forming of a hollow into a strain hardened tube with a roll stand with rollers rotatably mounted thereon, wherein the roll stand is motor driven moveable back and forth in a direction parallel to a longitudinal axis of the hollow between an in a feed direction of the hollow front point of return and an in the feed direction of the hollow rear point of return, wherein the rollers during a back and forth movement of the roll stand carry out a rotational motion, such that the rollers in operation of the cold pilger mill, mill the hollow into a tube, a mandrel, wherein the mandrel is mounted by mandrel bar at an in the feed direction of the hollow rear end of the mandrel bar, such that during operation of the cold pilger mill the hollow is milled by the rollers over the mandrel, at least one feed clamping sledge with a feed chuck mounted thereon to receive the hollow, wherein the feed clamping sledge is moveable back and forth in a direction parallel to the longitudinal axis of the hollow between an in the feed direction of the hollow front point of return and an in the feed direction of the hollow rear point of return such that the hollow in during operation of the cold pilger rolling mill experiences a stepwise infeed in a direction towards the mandrel, wherein the feed chuck is openable and closeable in a radial direction such that the hollow is released or clamped and with at least one mandrel thrust block with a chuck for mounting the mandrel bar, wherein a front mandrel thrust block is located in the feed direction of the hollow in front of the feed clamping sledge such that the mandrel bar during operation of the cold pilger rolling mill is mountable by the chuck of the front mandrel thrust block, wherein the chuck of the front mandrel thrust block is openable in a radial direction, such that a hollow is feedable between the front mandrel thrust block and the mandrel bar, and wherein the cold pilger rolling mill comprises an unwinding device, wherein the unwinding device is arranged and located in front of the front mandrel thrust block when viewed in the feed direction of the hollow such that a spindle with the hollow wound thereon is receivable at the unwinding device being rotatable about an axis being perpendicular to the feed direction of the hollow and during the operation of the cold pilger rolling mill the hollow is unwindable and feedable between the chuck of the front mandrel thrust block and the mandrel bar to the feed clamping sledge and the roll stand.

In particular hollows with the length of more than 30 m require a substantial space during feeding into the cold pilger rolling mill lengthwise. By the unwinding device according to the present invention with a hollow previously located wound up onto a spindle around a first axis can be space savingly fed into the cold pilger rolling mill.

In an embodiment the unwinding device comprises a straightening device which during the operation of the mill straightens the wound, i.e. curved, hollow, i.e. bends the hollow straight. An example for such a straightening device is a straightening machine, in particular a rolling straightening machine or a skew rolling straightening machine. In this way during unwinding of the hollow the hollow is straightened and simultaneously is loaded through the front mandrel thrust block into the hollow bed between the front mandrel thrust block and the feed chuck or between the front mandrel thrust block and the rear mandrel thrust block.

The unwinding device for the hollow according to the present invention thus leads to a more compact design of the overall arrangement of the cold pilger rolling mill, whereby additionally the operational costs are reduced.

In an embodiment of the invention the distance between the unwinding device and the front end of the front mandrel thrust block is smaller than the distance between the rear end of the front mandrel thrust block and the front end of the feed chuck of the rear feed clamping sledge at the rear point of return of the rear feed clamping sledge. In a further embodiment the distance between the unwinding device and the front end of the front mandrel thrust block is smaller than the distance between the rear end of the front mandrel thrust block and the front end of the rear mandrel thrust block.

In an embodiment of the present invention the front mandrel thrust block has a distance from the feed clamping sledge, when measured with the feed clamping sledge at its rear point of return, of at least 30 m.

A distance between the front mandrel thrust block and the feed chuck chosen this way enables the working of hollows with the lengths of 30 m or more in a cold pilger rolling mill according to the invention. Thereby the distance between the front mandrel thrust block and the feed chuck in an embodiment is measured between the rear end of the chuck of the front mandrel thrust block when viewed in the feed direction of the hollow and the front end of the feed chuck of the feed clamping sledge when viewed in the—feed direction of the hollow, wherein the feed clamping sledge is located at its rear point of return.

The previously defined distance amounts to at least 30 m and allows to locate a hollow between the front mandrel thrust block and the feed chuck of the feed clamping sledge such that the chuck of the front mandrel thrust block as well as the feed chuck of the feed clamping sledge can be closed without clamping the hollow. Consequently, the distance between the front mandrel thrust block and the feed chuck approximately describes the length of the hollow, which can be loaded into the cold pilger rolling mill according to the invention and which can be milled with a cold pilger rolling mill according to the invention.

When feeding the hollow into the cold pilger rolling mill the front mandrel thrust block is opened by opening the chuck of the mandrel thrust block in a radial direction such that the hollow can be fed between the front mandrel thrust block and the mandrel bar in the direction towards the mandrel. After the hollow has left the front mandrel thrust block, the chuck of the front mandrel thrust block is closed for mounting the mandrel bar.

Once in the sense of the present invention front and rear positions are described, these positions are denoted from a point of view of an observer looking along the hollow in the feed direction of the hollow.

In an embodiment of the present invention, the distance between the front mandrel thrust block and the feed chuck when measured with the feed clamping sledge at its rear point of return amounts to at least 40 m and in a further embodiment amounts to at least 50 m.

In an embodiment of the present invention the material of the mandrel bar of the cold pilger rolling mill comprises a tensile strength of 1000 N/mm$^2$ or more or of 1500 N/mm$^2$ or more.

In a further embodiment of the present invention, the mandrel bar is a tube having an outer diameter, an inner diameter as well as a wall thickness.

The tensile strength is a characteristic of the raw material and describes the maximum mechanic tensile stress, which the raw material can withstand before failure. The tensile strength is measured as a maximum tensile stress, which is related to the original cross section of the sample to be measured. The mandrel bar carrying the mandrel during milling of the hollow must receive high forces such that the raw material of which the mandrel bar is manufactured must comprise a high resilience with respect to its tensile strength.

Raw materials, which are suitable for this purpose, are for example heat-treated steels corresponding to DIN EN100 83, which through hardening and tempering obtain a high tensile strength and fatigue strength. The amount of carbon in heat-treated steels typically is between 0.2% and 0.65%, wherein different contents in the alloy of chromium, manganese, molybdenum and nickel in different fractions are blended depending on the application. Examples for alloyed heat-treated steels with a tensile strength of more than 1000 N/mm$^2$ are the steel grades 42 CrMo 4, 34 CrNiMo 6 and 30 CrNiMo 8.

In an embodiment of the present invention, the mandrel bar in addition comprises a strain of 10% or less and in an embodiment of 5% or less.

The strain is a gauge for the relative change in length of a sample under load, for example by a force or by a temperature change. A high strain of the mandrel bar during milling is also required in order to avoid that the mandrel bar fails due to a high strain. Equally as for the high tensile strength heat treated steels are suitable for a high strain. For example, the heat-treated steel 30 CrNiMo 8 besides a tensile strength of 1000 N/mm$^2$ also comprises a strain of 10% or less and is thus suitable as a raw material for the mandrel bar according to the invention.

In a further embodiment of the present invention, the cold pilger rolling mill comprises two feed clamping sledges with a feed chuck on each of them as well as a controller, wherein the controller is arranged such that the controller controls the motion of the two feed clamping sledges such that the hollow in a continuous operation of the cold pilger rolling mill is clampable alternately by one of the feed chucks and such that the hollow is feedable forward stepwise towards the mandrel, wherein the front mandrel thrust block comprises a distance of at least 30 m from the feed chuck of the rear feed clamping sledge when viewed in the feed direction of the hollow, measured with the feed clamping sledge at its rear point of return.

This way, a higher, i.e. continuous throughflow of hollows through the cold pilger rolling mill is enabled. This designs the milling process more efficient and more cost effective by reducing operational costs. Furthermore, no feed clamping sledge with a long distance of travel is required but the entire distance of travel is split into two sections such that each of the two feed clamping sledges must only cover one of the sections.

In a further embodiment of the present invention, the cold pilger rolling mill comprises a rear mandrel thrust block with a chuck for mounting the mandrel between the front point of return of the feed clamping sledge and the front mandrel thrust block when viewed in the feed direction of the hollow, wherein the rear mandrel thrust block comprises a distance from the front mandrel thrust block of at least 30 m such that the mandrel bar during operation of a cold pilger rolling mill is mountable by at least one chuck of the front mandrel thrust block or of the rear mandrel thrust block.

The distance between the front mandrel thrust block and the rear mandrel thrust block in an embodiment is defined as the distance between the rear end of the front mandrel thrust block when viewed in the feed direction of the hollow and the front end of the rear mandrel thrust block when viewed in the feed direction of the hollow. A hollow which at maximum comprises a length of this distance can thus be loaded between the front mandrel thrust block and the rear mandrel thrust block, i.e. can be located between them when the chucks of the front mandrel thrust block as well as of the rear mandrel thrust block are closed and hold the mandrel, i.e. without thereby clamping the hollow.

Placing the rear mandrel thrust block between the front point of return of the feed clamping sledge and the front mandrel thrust block in addition to the front mandrel thrust block enables machining of a plurality of long hollows, i.e. with a length of 30 m or more, in a continuous operation. When a hollow has already fully passed the rear mandrel thrust block and is milled over the mandrel, the rear mandrel thrust block is closed to mount the mandrel bar. The front mandrel thrust block then no longer needs to mount the mandrel bar and in contrast to the rear mandrel thrust block can be opened again such that a further hollow can be fed into the cold pilger rolling mill.

In an embodiment, the cold pilger rolling mill in addition to a rear mandrel thrust block and a front mandrel thrust block comprises two feed clamping sledges with a feed chuck each.

The cold pilger rolling mill according to the invention consequently is suitable for an efficient and cost effective cold pilger milling of long hollows with a length of 30 m or more.

In a further embodiment of the present invention, each feed clamping sledge of the cold pilger rolling mill is arranged such that it can feed a hollow with a weight of 100 kg/m or more. In an embodiment of the invention, each feed clamping sledge is arranged such that the feed clamping sledge can feed a hollow with a weight in a range between 100 kg/m and 150 kg/m. In order to be able to feed in particular hollows with a length of more than 30 m and a weight per length between 100 kg/m and 150 kg/m, the feed clamping sledge in an embodiment comprises a correspondingly dimensioned linear drive for feeding the hollow towards the mandrel. Furthermore, the chuck also comprises a correspondingly strong rotational drive to rotate the hollow around its longitudinal axis.

In a further embodiment of the present invention, each feed clamping sledge of the cold pilger rolling mill is arranged such that the feed clamping sledge can feed a hollow with a weight of 125 kg/m or more.

In an embodiment of the present invention, a winding device is located in the feed direction of the hollow behind the rollers of the mill, wherein the winding device comprises a bending device for the tube manufactured in the mill to bend the tube such that the tube is windable around a first axis, and mounting frame, wherein the bending device and the first axis are pivotably mounted at the mounting frame about a second axis which is essentially perpendicular to the first axis and which is parallel to a longitudinal axis of a hollow received between the rollers.

Such a space saving embodiment reduces the costs for manufacturing long tubes substantially as due to the winding of long tubes by a winding device or may dispense with large, in particular very long workshops.

Such a winding device furthermore allows to receive the finished formed tube released from the cold pilger rolling mill and to bend the tube such that it can be wound on a spiral path. This substantially reduces the time for production of steel tubes, which are dimensioned such that they are windable. The tube released from the roll stand can already be wound while simultaneously parts of the same hollow are still fed into the pilger mouth and milled between the rollers. Furthermore, the winding device allows a substantial reduction in space for the cold pilger rolling mill as such as during the manufacturing of the tube not the entire strand must be released from the roll stand first before the strand is wound up.

An essential aspect of the winding device is that the bending device and the first axis are pivotably mounted around a second axis. This way, the winding device can follow a pivoting motion of the tube or the hollow during milling caused by the feed clamping sledge and the tube can be wound without twisting. Without a corresponding pivotable mounting of the bending device and the first axis, a twisting of the tube during winding would occur and thus a related substantial reduction of quality of the finished tube.

The second axis around which the bending device and the first axis are pivotably mounted at the mounting frame is parallel to the axis of symmetry of the finished tubes released from the roll stand. In an embodiment, the second axis is identical with the symmetry axis of the finished tube released from the roll stand.

In a further embodiment of the invention, the bending device and the first axis are pivotably driven by a motor around the second axis. While in principle the pivoting motion of the bending device can be caused by the pivoting motion of the finished tube released from the roll stand, the motor drive largely avoids that the tube during winding experiences any torsional stresses. A detailed explanation of embodiments of such a winding device is disclosed in German patent application DE 10 2009 045 640 A1.

In a further embodiment of the present invention, the feed chuck of the feed clamping sledge is arranged to be pivotably driven by a motor and receives the hollow being pivotable around its longitudinal axis and the cold pilger rolling mill furthermore comprises a controller, wherein the controller is arranged such that the controller during operation the winding device pivots the feed chuck and the bending device as well as the first axis of the winding device synchronous with identical angular velocity. In such an embodiment, the bending device is pivotably mounted and motor driven about the second axis at the mounting frame. The "electronic axle" between the feed clamping sledge and the winding device enables winding of the finished tube almost free of rotational stress.

Such a space saving embodiment further reduces the manufacturing costs of long tubes substantially as due to the winding of long tubes on a winding device very large, in particular very long workshops become expendable.

In a further embodiment of the present invention the cold pilger rolling mill comprises an annealing furnace, wherein the annealing furnace is arranged such that the furnace during an operation of the cold pilger rolling mill heats the hollow to a temperature in a range from 1000° C. to 1200° C. or in a range from 1050° C. to 1150° C.

Thereby the annealing furnace in an embodiment is arranged such that a hollow wound onto a spindle is annealable in the annealing furnace. In an embodiment, the annealing furnace thus is a shaft oven. In an alternative embodiment, the hollow is heated lengthwise in a continuous furnace to the above temperatures.

In a further embodiment of the present invention, the cold pilger rolling mill comprises a second cold pilger rolling mill for cold forming a hollow such that the hollow in the second cold pilger rolling mill is formable into a hollow to be fed into an embodiment of the previously discussed cold pilger rolling mill such that a tube released from the cold pilger rolling mill is a twice or more times milled tube.

In a further embodiment, each of the chucks of each of the mandrel thrust blocks comprises through holes for mounting of clamping jaws such that at least three clamping jaws of a thrust block grip the mandrel bar. This enables an easy, uncomplicated fixing of the mandrel bar by the gripping of the clamping jaws such that during operation of the cold pilger rolling mill at least one mandrel thrust block mounts the mandrel bar while the clamping jaws of the other mandrel thrust blocks are opened for feeding through a hollow.

In an embodiment, the chucks of the respective mandrel thrust block mount the mandrel bar intermittently. By such an intermittent mounting of the mandrel bar, a continuous operation of the cold pilger rolling mill is enabled such that one mandrel thrust block mounts the mandrel bar while the other mandrel thrust blocks allows a feed through of the hollow.

At least one of the above objects according to the present invention furthermore is solved by a method for manufacturing a tube by cold forming a hollow in a cold pilger rolling mill with a roll stand with rollers pivotably mounted thereon, a mandrel mounted by a mandrel bar, at least one mandrel thrust block mounting the mandrel bar and at least one feed clamping sledge with a feed chuck for receiving the hollow with the steps:

a) opening a chuck of an in a feed direction of the hollow front mandrel thrust block in a radial direction and feeding a first hollow through the front mandrel thrust block between the chuck of the front mandrel thrust block and the mandrel bar, b) after completely feeding of the first hollow through the front mandrel thrust block closing the chuck of the front mandrel thrust block in the radial direction such that the front mandrel thrust block mounts the mandrel bar carrying the mandrel, c) feeding the first hollow to a feed clamping sledge and receiving the first hollow by opening the feed chuck in the radial direction and clamping the first hollow by closing the feed chuck in the radial direction at an in the feed direction of the hollow front point of return of the feed clamping sledge, and d) milling the first hollow by the rollers over the mandrel into a strain hardened tube by stepwise feeding the first hollow by means of the feed clamping sledge and oscillatory back and forth movement of the roll stand with the rollers between a front point of return and a rear point of return, wherein prior to step a) in a step a') the first hollow wound up on a spindle is provided and unwinding of the first hollow from the spindle with an unwinding device is carried out.

Except that the chuck of the mandrel thrust block can only be closed once the hollow has fully passed the chuck, the order of the steps given above does not necessarily restrict the order of the steps to be carried out. In particular feeding of the hollow towards the feed clamping sledge may already carried out when the chuck of the front mandrel thrust block is opened.

In an embodiment, the hollow wound onto the spindle during unwinding is guided through bending rollers which straighten the hollow again in its longitudinal direction prior to the hollow passing the front mandrel thrust block. The straightening of the hollow from its original shape by the bending rollers thereby occurs during the loading of the hollow into the cold pilger rolling mill, i.e. during the feeding of the hollow through the front mandrel thrust block.

Such a method like a winding device saves a lot of space in the workshop in which the cold pilger rolling mill is located and thus reduces the manufacturing costs for the long tubes manufactured in the cold pilger rolling mill.

The method according to the invention enables a working of a long hollow, in particular of a hollow with a length of 30 m or more, in a cold pilger rolling mill and thus the forming of a hollow into a cold formed strain hardened tube with a length of at least 300 m. The finished tube thereby comprises a high quality due to the manufacturing process in the cold pilger rolling mill. This represents a significant advancement in comparison to the prior art as cold pilger rolling mills according to the prior art may only work hollows up to a length of about 15 m and thus may only manufacture integrally formed tubes up to a certain length.

Thus, the first hollow in an embodiment of the present invention comprises a length of 30 m or more.

An embodiment of the inventive method relates to a method for manufacturing a tube with the following steps after step a) and prior to step b):

e) opening of a chuck of an in the feed direction of the hollow rear mandrel thrust block, located between the front point of return of an in the feed direction of the hollow front feed clamping sledge and the front mandrel thrust block, in a radial direction, wherein the rear mandrel thrust block comprises a distance of at least 30 m from the front mandrel thrust block, and feeding a first hollow through the rear mandrel thrust block, wherein the milling of the first hollow by the rollers over the mandrel into a strain hardened tube in step d) is caused by stepwise feeding the first hollow intermittently by means of the front feed clamping sledge from a front point of return to a rear point of return of the front feed clamping sledge and by means of an in the feed direction of the hollow rear feed clamping sledge from a front point of return to a rear point of return of the rear feed clamping sledge and oscillatorily moving the roll stand back and forth between a front point of return and a rear point of return of the rollers, and wherein the method in addition comprises the steps of:

f) after completely feeding the first hollow through the rear mandrel thrust block closing the chuck of the rear mandrel thrust block in a radial direction such that the rear mandrel thrust block mounts the mandrel bar carrying the mandrel, g) during the milling of the first hollow unwinding a second hollow, wherein the second hollow is wound on a spindle being rotatable around an axis being perpendicular to the feed direction of the hollow, h) opening the chuck of the front mandrel thrust block and feeding the second hollow through the front mandrel thrust block into the area between the front mandrel thrust block and the rear mandrel thrust block, i) after completely feeding the second hollow through the front mandrel thrust block closing the chuck of the front mandrel thrust block such that the front mandrel thrust block mounts the mandrel bar carrying the mandrel, j) opening the chuck of the rear mandrel thrust block, k) feeding the second hollow through the rear mandrel thrust block, l) feeding the second hollow to the front feed clamping sledge and receiving the second hollow in the feed chuck of the front feed clamping sledge and clamping the second hollow by closing the feed chuck of the front feed clamping sledge in a radial direction, m) opening the feed chuck of the rear feed clamping sledge in a radial direction, n) stepwise feeding the second hollow intermittently by means of the front feed clamping sledge and by the rear feed clamping sledge while the second hollow is clamped, o) after completely discharging of the finished tube milled out of the first hollow from the roll stand inserting the second hollow into the roll stand and p) milling the second hollow by the rollers over the mandrel into a strain hardened tube by stepwise feeding the second hollow intermittently by means of the rear feed clamping sledge and of the front feed clamping sledge and oscilatorilly moving back and forth the roll stand between a front point of return and a rear point of return with the rollers.

Such a method enables a cold pilger milling of long hollows, i.e. hollows with a length of 30 m or more, in a continuous operation such that a first hollow is milled while a second hollow is inserted into the cold pilger rolling mill. This is in particular achieved by the presence of two mandrel thrust blocks. One mandrel thrust block must always be closed such that the mandrel thrust block during the milling mounts the mandrel bar. In case of two mandrel thrust blocks, a front mandrel thrust block and a rear mandrel thrust block, one mandrel thrust block mounts the mandrel bar fixedly in its position while the other mandrel thrust block is opened to feed the second hollow. The operation of the cold pilger rolling mill is thus accelerated by the presence of at least two mandrel thrust blocks.

While the front feed clamping sledge and the rear feed clamping sledge intermittently feed the second hollow in a direction towards the mandrel also the first hollow experiences a feeding in a direction towards the mandrel. The feed of the first hollow during this phase of the method is caused indirectly by the intermittent linear drive of the front feed clamping sledge and the rear feed clamping sledge as the first hollow is pushed by the second hollow being fed by the front feed clamping sledge and the rear feed clamping sledge.

A further embodiment of the present invention relates to a method for manufacturing a tube, wherein a winding of an already completely milled parts of the hollow occurs simultaneously with the milling of a part of the hollow to be milled into the strain hardened tube with the steps: bending of a part of the hollow which is already completely milled in a bending device, spirally winding up the already completely milled part of the hollow around a first axis and pivoting of the bending device mounted at a mounting frame and the first axis around the second axis being essentially perpendicular to the first axis and being essentially parallel to a longitudinal axis of a hollow located between the rollers such that the pivoting is carried out with the same angular velocity as a pivoting of the hollow around its longitudinal axis during the milling of the hollow.

By use of such a method the already completed milled part of the hollow, i.e. the part of the already finished tube, is wound around a first axis by means of a winding device while simultaneously a further part of the hollows still milled by the pivotably mounted rollers on the roll stand over the mandrel and potentially a further part of the hollow is still fed in a direction towards the pilger mouth. The winding up in the winding device is thereby carried out such that the completely milled tube in a bending device first is bend. Due to its bending the tube is then spirally wound around a first axis, wherein in addition to the winding a pivoting of the bending device as well as the first axis around a second axis is carried out. Thereby the second axis is essentially perpendicular to the first axis as well as parallel to a longitudinal axis of a hollow located between the rollers. Thereby in an embodiment, the second axis coincides with the longitudinal axis of the hollow located between the rollers.

Furthermore, a pivoting of the bending device as well as the first axis around the second axis occurs with the same angular velocity as a pivoting of the hollow around its longitudinal axis such that twisting of the tube during winding and a substantial reduction in quality going along with this is avoided.

A further embodiment of the inventive method for manufacturing a tube is characterized in that prior to the feeding of the hollow through the front mandrel thrust block the hollow located wound up on a spindle is heated to a temperature in a range from 1000° C. to 1200° C. In particular, in an embodiment of the inventive method the hollow is heated to a temperature in a range from 1050° C. to 1150° C.

In a further embodiment of the inventive method prior to the annealing of the hollow a further cold forming of the hollow in a second cold pilger rolling mill is carried out such that the finished tube is manufactured by multiple cold forming of a hollow. By a multiple cold forming of a hollow, the tensile strength of the finished tube is further enhanced such that the finished tube after the multiple cold forming of a hollow comprises a higher resilience.

Further advantages, features and applications of the present invention become apparent from the following description of embodiments thereof as well as the appended figures.

In the figures, identical elements are denoted by identical reference numbers.

Figure 1:
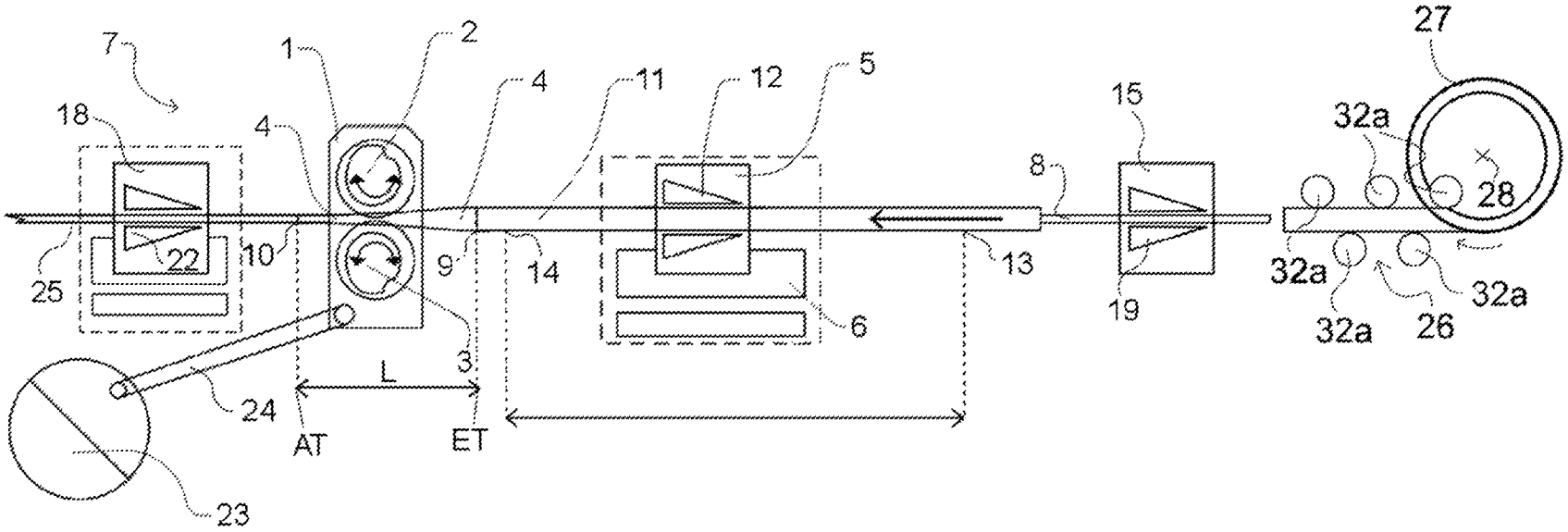
FIG. 1 shows a schematic side view of the arrangement of a cold pilger rolling mill with an unwinding device according to an embodiment of the present invention.

In FIG. 1, the design of an inventive cold pilger rolling mill is schematically shown in a side view. The cold pilger rolling mill 7 consists of a roll stand 1 with an upper roller 2 and a lower roller 3, a calibrated mandrel 4 (in the figure, the position of the mandrel is denoted by reference number 4), a mandrel bar 8 carrying the mandrel 4, a feed clamping sledge 5 with a feed chuck 12 to receive a hollow 11, a front mandrel thrust block 15 with a chuck 19 as well as a discharge clamping sledge 18 with a chuck 22. In the embodiment shown, the cold pilger rolling mill comprises a linear motor 6 as a direct drive for the feed clamping sledge 5.

Figure 2:
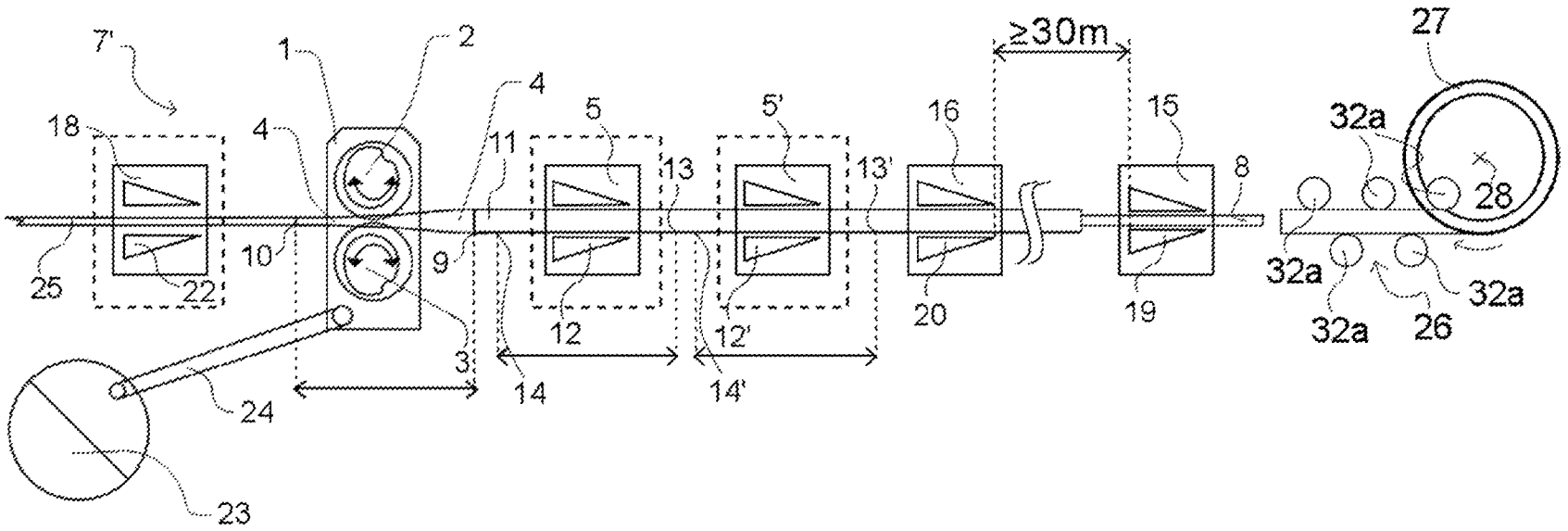
FIG. 2 shows a schematic side view of a design of a cold pilger rolling mill with an unwinding device, a front mandrel thrust block and a rear mandrel thrust block as well as two feed clamping sledges according to a further embodiment of the present invention.
Figure 3:
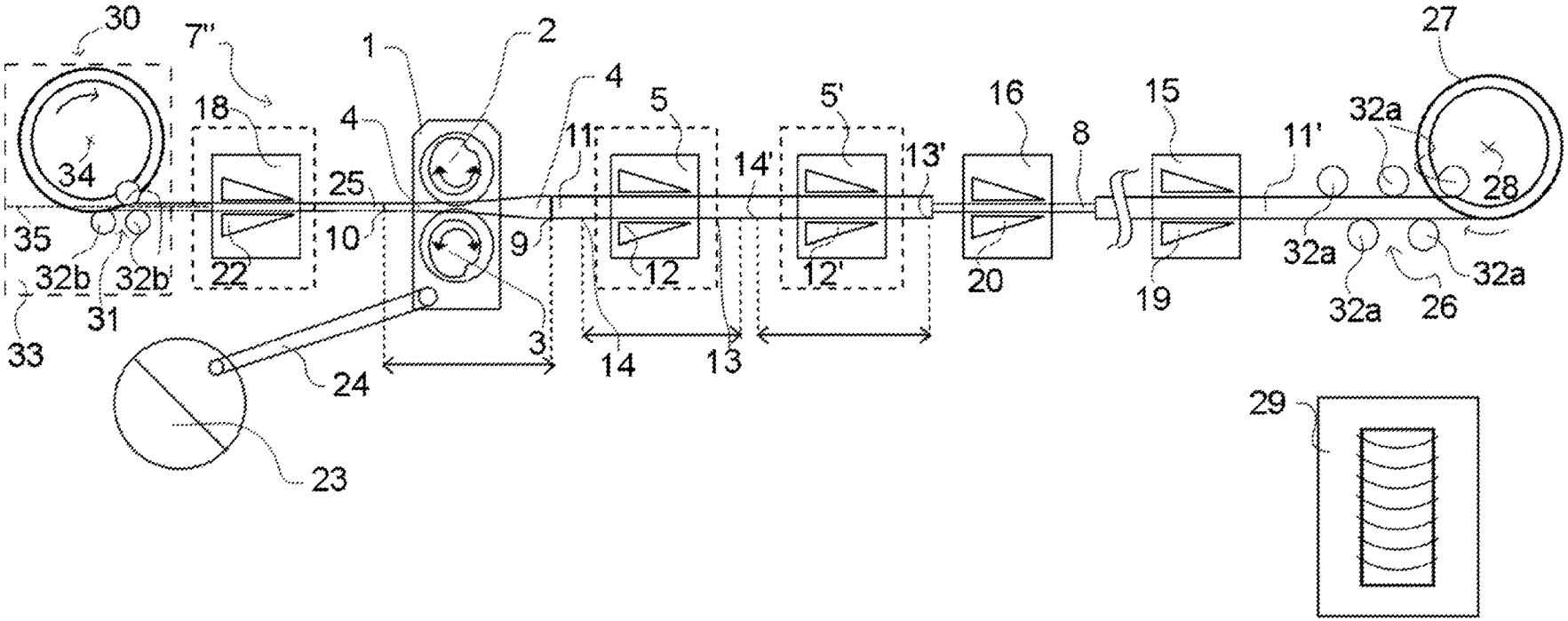
FIG. 3 shows a schematic side view of an arrangement of a cold pilger rolling mill with an unwinding device, a front mandrel thrust block and a rear mandrel thrust block, two feed clamping sledges and a winding device according to a further embodiment of the present invention.

Like in all embodiments of FIGS. 1 to 3 the cold pilger rolling mill 7 comprises an unwinding device 26 for the provision of the hollow 11. The unwinding device 26 is arranged such that a hollow located wound up around an axis 28 being perpendicular to the feed direction of the hollow 11 on a spindle 27 is unwound. Thereby the spindle 27 is rotated driven by a motor around the first axis 28 in direction of the arrow shown such that the hollow located wound up on the spindle 27 is guided between five bending rollers 32*a*. Three bending rollers 32*a* thereby are located in an upper row and two bending rollers 32*a* are located in a lower row. The bending rollers 32*a* bend the hollow fit through homogeneously and in opposite directions each such that the hollow is bend straight and is straightened between the bending rollers 32*a* prior to the hollow being fed through the chuck 19 of the front mandrel thrust block 15. The straightening of the hollow 11 in the initial state thereby is carried out during the loading of the hollow 11 through the front mandrel thrust block 15 into the cold pilger rolling mill 7.

Integration of the unwinding device 26 into the cold pilger rolling mill as shown in the figures and thus of the unwinding into the milling process is in particular advantageous for hollows with a length of more than 30 m. By unwinding of the hollow 11 located wound up on the spindle 27 and by simultaneously feeding the hollow 11 to and through the front mandrel thrust block 15, a large space in a workshop in which the cold pilger rolling mill is located, can be saved.

During the cold pilger milling in the cold pilger rolling mill shown in FIG. 1 the hollow 11 experiences a stepwise feed in a direction towards the mandrel 4 and over the mandrel, while the rollers 2, 3 are moved horizontally back and forth over the mandrel 4 and thus over the hollow 11. Thereby the horizontal motion of the rollers 2, 3 is guided by the roll stand 1 at which the rollers 2, 3 are pivotably mounted. The roll stand 1 is moved back and forth by means of a crank drive 23 via a push rod 24 in a direction parallel to the longitudinal axis of the hollow between the in the feed direction of the hollow 11 front point of return 9, which is denoted as the feed dead center ET, and an in the feed direction of the hollow 11 rear point of return 10, which is also denoted as the discharge dead center AT. The rollers 2, 3 in turn receive their rotating motion from a tooth bar (not shown) which relatively to the roll stand 1 is fixed, in which tooth bar gear wheels (not shown) fixedly mounted on the roller axis engage. The feed of the hollow 11 over the mandrel 4 is carried out by means of the feed clamping sledge 5, which enables a translational motion in the direction parallel to the axis of the hollow 11. The feed clamping sledge 5 thereby carries out a motion back and forth between an in the feed direction of the hollow 11 front point of return 13 and an in the feed direction of the hollow 11 rear point of return 14. The path of the feed clamping sledge 5 between the two points of return 13, 14 in the embodiment of FIG. 1 amounts to 24 m.

As soon as the hollow 11 is released from the front mandrel thrust block 15 the chuck 19 of the front mandrel thrust block 15 is closed in a radial direction such that the chuck 19 fixedly clamps the mandrel bar 8. Thereby, the front mandrel thrust block 15 in FIG. 1 comprises a distance from the feed chuck 12 of the feed clamping sledge 5 when the feed clamping sledge 5 is located at its rear point of return 14 of 36 m. This distance is measured between the rear end of the chuck 19 of the front mandrel thrust bar 15 in the feed direction of the hollow and the front end of the feed chuck 12 of the feed clamping sledge in the feed direction of the hollow when the feed clamping sledge is located at its rear point of return 14. Consequently, a hollow with a maximum length of 36 m could be located between the front mandrel thrust block 15 and the feed chuck 12 of the feed clamping sledge 5 located at its rear point of return 14 without the hollow being clamped by the chuck 19 of the front mandrel thrust block 15 or the chuck 12 of the feed clamping sledge 5.

The mandrel bar 8 in FIG. 1 consists of a raw material 30 CrNiMo 8 and comprises a tensile strength of 1000 N/mm$^2$ as well as a strain of 8%.

At the in the feed direction of the hollow 11 front point of return 9 of the roll stand 1 the hollow 11 enters between the rollers 2, 3 and is received by the receiving pocket (not depicted) of the rollers 2, 3. The conically calibrated rollers 2, 3 arranged above each other at the roll stand 1 mill the hollow 11 by rolling back and forth on the hollow 11 in the feed direction of the feed clamping sledge 5. The pair of rollers during a milling stroke moves by a path L from the front point of return 9 of the roll stand 1 (feed dead center ED in the feed direction to the rear point of return 10 (discharge dead center AT) of the roll stand 1 in the feed direction of the hollow.

This in FIG. 1 corresponds to a rotation of the rollers by an angle of 280°. Thereby, the pair of rollers 2, 3 stretches the hollow 11 over the mandrel 4 mounted inside the hollow 11. The rollers 2, 3 and the mandrel 4 are calibrated such that the gap between the roller 2, 3 and the mandrel 4 is reduced in the working caliber zone of the rollers 2, 3 continuously from the wall thickness of the hollow 11 to the wall thickness of the finished milled tube 25. Furthermore, the outer diameter defined by the rollers is reduced from the outer diameter of the hollow to the outer diameter of the finished tube and the inner diameter defined by the mandrel is reduced from the inner diameter of the hollow to the inner diameter of the tube. After the working caliber zone of the rollers 2, 3 the planing caliber zone of the rollers 2, 3 follows in which a planning of a surface of the tube 25 to be manufactured is carried out. When reaching the rear point of return 10 of the roll stand 1 the discharge pocket (not shown) of the rollers 2, 3 releases the finished milled tube.

In order to obtain a homogenous shape of the finished tube 25, the hollow 11 besides a feed experiences an intermittent rotation around its longitudinal axis. The rotation of the hollow 11 occurs at both point of returns 9, 10 of the roll stand 1. By multiply milling each tube section a homogenous wall thickness and roundness of the tube as well as homogenous inner and outer diameters are achieved.

The finished tube 25 is received by a chuck 22 of a discharge clamping sledge 18 and is drawn out of the cold pilger rolling mill 7.

FIG. 2 shows a schematic design of a further cold pilger rolling mill according to the invention in a side view. In contrast to FIG. 1 the cold pilger rolling mill 7' depicted in FIG. 2 comprises two feed clamping sledges 5, 5' with a feed chuck 12, 12' each for receiving a hollow 11. Both feed clamping sledges 5, 5' are each moveable between their front 13, 13' and rear points of return 14, 14' by 12 m and are thus characterized by a smaller travelling distance when compared to the feed clamping sledge 5 shown in FIG. 1. The in the feed direction of the hollow 11 front feed clamping sledge 5' has already forwarded the hollow in a direction towards the mandrel 4 to a point slightly in front of its rear point of return 14'. The in the feed direction of the hollow 11 rear feed clamping sledge 5 moves towards the front feed clamping sledge 5' in a direction opposite to the feed direction such that the front feed clamping sledge 5' once it has arrived at its rear point of return 14' can hand over the hollow 11 to the rear feed clamping sledge 5 at its front point of return 13. After the hollow 11 has been received by the rear feed clamping sledge 5 the rear feed clamping sledge 5 in a next step would forward the hollow 11 stepwise in a direction towards the mandrel 4 while the front feed clamping sledge 5' would return to its front point of return 13' in order to receive a further hollow 11'. This way a continuous operation of the mill is possible which avoids dead times during return of a single feed clamping sledge 5 as it is shown in FIGS. 1 and 2 from its rear point of return to its front point of return.

In contrast to the cold pilger rolling mill 7 shown in FIG. 1 the cold pilger rolling mill 7' of FIG. 2 further comprises another, in the feed direction of the hollow 11 rear mandrel thrust block 16 in addition to the front mandrel thrust block 15. The rear mandrel thrust block 16 is located between the front point of return 13' of the front feed clamping sledge 5' and the front mandrel thrust block 15 and like the front mandrel thrust block 15 comprises a chuck 20 for mounting the mandrel bar 8. The hollow 11 in FIG. 2 has already left the front mandrel thrust block 15 such that the chuck 19 of the front mandrel thrust block 15 is closed and the mandrel bar 8 is fixedly clamped. The chuck 20 of the rear mandrel thrust block 16 in contrast is open and lets the hollow 11 pass between the chuck 20 and the mandrel bar 8.

In FIG. 2 the distance between the front mandrel thrust block 15 measured at the in the feed direction of the hollow rear end of the chuck 19 and the rear mandrel thrust block 16 amounts to 38 m, while the hollow 11 shown in FIG. 2 comprises a length of 37 m. Consequently, the hollow 11 can be located between the front mandrel thrust block 15 and the rear mandrel thrust block 16 and the chucks 19, 20 of both mandrel thrust blocks 15, 16 can be closed without the chucks 19, 20 clamping the hollow 11.

In FIG. 3 a cold pilger rolling mill 7" according to the invention is shown in a schematic side view, which in comparison to the cold pilger rolling mill 7' shown in FIG. 2 in addition to the two feed clamping stages 5, 5', the front mandrel thrust block 15 and the rear mandrel thrust block 16 also comprises a winding device 30.

In order to wind up the finished tube 25 behind the roll stand 1 into a transportable shape the cold pilger rolling mill 7" shown in FIG. 3 also comprises a winding device 30. The winding device 30 which in FIG. 3 is shown schematically consists of a mounting frame 33 and a bending device 31. The bending device 31 comprises three bending rollers **32*b* which in the shown embodiment all three are motor driven and are frictionally engaged with the finished tube 25**.

The already finished milled part of the hollow, i.e. the part of the already finished tube 25 first is 30 received by a chuck 22 of a discharge clamp sledge 18 and is drawn in a direction towards the winding device 30. As soon as a part of the already finished tube 25 enters between the bending rollers **32*b* of the bending device 31 of the winding device 30 this part of the finished tube 25** is bend by two bending rollers

32*b* above the finished tube 25 and a bending roller 32*b* below the finished tube 25. Due to a motor driven rotation of the bending device 30 in a direction of the arrow 35 drawn in FIG. 3 the bend part of the finished tube 25 is spirally wound up around a first axis 34.

The bending device 31 and the three bending rollers 32*b* furthermore are pivotably mounted at the mounting frame 33 around a second axis 35 which coincides with the longitudinal axis of the finished tube 25 exiting the discharge clamping sledge 18. Thereby the pivoting motion of the bending rollers 32*b* around the second axis 35 is carried out by means of a motor drive. The pivoting motion 5 occurring simultaneously with the winding up is carried out with the same angular velocity as the pivoting motion of the hollow 11 around its longitudinal axis during the milling of the hollow 11. Consequently, both pivoting motions occur synchronous with each other. This has the advantage that a twisting of the finished tube 25 during winding up is avoided entirely, at least essentially and the finished tube 25 is wound up without torsional stresses during milling.

In addition in the same workshop an annealing furnace 29 is provided in which the hollow is annealed prior to the feeding into the cold pilger rolling mill 7''' and after a first milling in a second cold pilger rolling mill.

For purposes of the original disclosure it is pointed out that all features which are apparent for a person skilled in the art from the present description, from the figures and from the claims, even if they are only disclosed in combination with certain further features, are combinable on their own as well as in arbitrary combinations with other features and feature groups disclosed herein as far as this I not explicitly excluded or technical circumstances make such combination impossible or useless. A full explicit description of all possible combinations of features is only omitted to provide a short and readable description. While the invention is shown in detail in the figures and the above description this representation and description is only an example and is not considered a restriction of the scope of protection as it is defined by the claims. The invention is not restricted to the disclosed embodiments.

Modifications of the disclosed embodiments are apparent for a person skilled in the art from the figures, the description and the dependent claims. In the claims the word "comprises" does not exclude other elements or steps. The indefinite article "a" or "an" does not exclude a plurality. The mere fact that some features are claimed in different claims does not exclude their combination. Reference signs in the claims are not considered as a restriction of the scope of protection.

REFERENCE LIST

1 roll stand
2, 3 upper, lower roller
4 mandrel
5 feed clamping sledge
6 linear motor
7, 7', 7" cold pilger rolling mill
8 mandrel bar
9 front point of return of the roll stand
10 rear point of return of the roll stand
11 hollow
12 feed chuck
13 front point of return of the feed clamping sledge
14 rear point of return of the feed clamping sledge
15 front mandrel thrust block
16 rear mandrel thrust block
18 discharge clamping sledge for the finished tube
19, 20, 22 chuck
23 crank drive
24 push rod
25 finished tube
26 unwinding device
27 spindle
28 first axis (unwinding device)
29 annealing furnace
30 winding device
31 bending device
32*a*, 32*b* bending roller
33 mounting frame
34 first axis (winding device)
35 second axis (winding device)

The invention claimed is:

1. A cold pilger rolling mill for cold forming of a hollow into a tube comprising:

a roll stand with rollers rotatably mounted thereon, wherein the roll stand is motor driven and moveable back and forth in a direction parallel to a longitudinal axis of the hollow between a first roll stand position and a second roll stand position, wherein the first roll stand position corresponds to a front point of return of the roll stand and the second roll stand position corresponds to a rear point of return of the roll stand, wherein the front point of return of the roll stand is in front of the rear point of return of the roll stand in a feed direction of the hollow, wherein the rollers, during a back and forth movement of the roll stand, carry out a rotational motion, and wherein, in an operation of the cold pilger rolling mill, the rollers mill the hollow into the tube, a mandrel, wherein the mandrel is mounted by a mandrel bar so that, during the operation of the cold pilger rolling mill, the hollow is milled by the rollers over the mandrel, a first feed clamping sledge with a first feed chuck mounted thereon to receive the hollow, wherein the first feed clamping sledge is moveable back and forth in the direction parallel to the longitudinal axis of the hollow between a first sledge position and a second sledge position, wherein the first sledge position corresponds to a front point of return of the first feed clamping sledge and the second sledge position corresponds to a rear point of return of the first feed clamping sledge, wherein the front point of return of the first feed clamping sledge is in front of the rear point of return of the first feed clamping sledge in the feed direction of the hollow, wherein, in the operation of the cold pilger rolling mill, the hollow experiences a stepwise feed in the feed direction towards the mandrel, and wherein the first feed chuck is openable and closeable in a radial direction to release or clamp the hollow, at least one mandrel thrust block with a chuck for mounting the mandrel bar, wherein the at least one mandrel thrust block includes a front mandrel thrust block that, relative to the feed direction of the hollow, is located in front of the first feed clamping sledge, wherein, in the operation of the cold pilger rolling mill, the mandrel bar is mountable by the chuck of the front mandrel thrust block, wherein the chuck of the front mandrel thrust block is openable in the radial direction so that the hollow is feedable between the chuck and the mandrel bar, and an unwinding device having a spindle, wherein the unwinding device, relative to the feed direction of the hollow, is located in front of the front mandrel thrust block so that the spindle with the hollow wound thereon is receivable at the unwinding device, wherein the unwinding device is rotatable about an axis perpendicular to the feed direction of the hollow and, in the operation of the cold pilger rolling mill, the hollow is unwindable and feedable between the chuck of the front mandrel thrust block and the mandrel bar to the first feed clamping sledge and to the roll stand, wherein the front mandrel thrust block is at a distance from the first feed clamping sledge, measured with the first feed clamping sledge at the second sledge position, of at least 30 m, and wherein the mandrel bar has a tensile strength of 1000 $N/mm^2$ or more and a strain of 10% or less.

2. The cold pilger rolling mill according to claim 1, wherein the cold pilger rolling mill further comprises:

a controller, and a second feed clamping sledge with a second feed chuck mounted thereon, wherein the controller is configured to control a back and forth movement of the first feed clamping sledge and a back and forth movement of the second feed clamping sledge, wherein, in the operation of the cold pilger rolling mill, one of the first feed chuck and the second feed chuck alternatively clamp the hollow so as to stepwise feed the hollow towards the mandrel, and wherein the second feed clamping sledge, relative to the feed direction of the hollow, is in front of the first feed clamping sledge.

3. The cold pilger rolling mill according to claim 2, wherein the at least one mandrel thrust block further includes a rear mandrel thrust block with a rear chuck for mounting the mandrel bar, the rear mandrel thrust block located between a front point of return of the second feed clamping sledge and the front mandrel thrust block when viewed in the feed direction of the hollow, and wherein the rear mandrel thrust block is at a distance from the front mandrel thrust block of at least 30 m such that the mandrel bar during operation of the cold pilger rolling mill is mountable by at least one of the chuck of the front mandrel thrust block or the rear chuck of the rear mandrel thrust block.

4. The cold pilger rolling mill according to claim 2, wherein both the first feed clamping sledge and the second feed clamping sledge are each configured to feed the hollow having a weight of 100 kg/m or more.

5. The cold pilger rolling mill according to claim 2, further comprising a winding device that is located behind the rollers in the feed direction of the hollow, wherein the winding device comprises a mounting frame and a bending device to bend the tube such that the tube is windable around a first axis, wherein the bending device and the first axis are pivotably mounted on the mounting frame about a second axis, and wherein the second axis is perpendicular to the first axis and parallel to the longitudinal axis of the hollow received between the rollers.

6. The cold pilger rolling mill according to claim 2, further comprising an annealing furnace, wherein the annealing furnace is configured to heat the hollow to a temperature in a range from 1000° C. to 1200° C.

7. The cold pilger rolling mill according to claim 1, wherein the first feed clamping sledge is configured to feed the hollow having a weight of 100 kg/m or more.

8. The cold pilger rolling mill according to claim 1, further comprising a winding device that is located behind the rollers in the feed direction of the hollow, wherein the winding device comprises a mounting frame and a bending device to bend the tube such that the tube is windable around a first axis, wherein the bending device and the first axis are pivotably mounted on the mounting frame about a second axis, and wherein the second axis is perpendicular to the first axis and parallel to the longitudinal axis of the hollow received between the rollers.

9. The cold pilger rolling mill according to claim 1, further comprising an annealing furnace, wherein the annealing furnace is configured to heat the hollow to a temperature in a range from 1000° C. to 1200° C.

10. A method for manufacturing a tube in a cold pilger rolling mill with a roll stand with rollers pivotably mounted thereon, a mandrel mounted by a mandrel bar, a front mandrel thrust block mounting the mandrel bar, and a first feed clamping sledge with a first feed chuck, wherein the roll stand is motor driven and moveable back and forth in a direction parallel to a longitudinal axis of the hollow between a first roll stand position and a second roll stand position, and wherein the first feed clamping sledge is moveable back and forth in the direction parallel to the longitudinal axis of the hollow between a first sledge position corresponding to a front point of return of the first feed clamping sledge and a second sledge position corresponding to a rear point of return of the first feed clamping sledge, the method comprising the steps:

a) opening a chuck of the front mandrel thrust block in a radial direction and feeding a first hollow through the front mandrel thrust block between the chuck of the front mandrel thrust block and the mandrel bar, b) after completely feeding the first hollow through the front mandrel thrust block, closing the chuck of the front mandrel thrust block in the radial direction such that the front mandrel thrust block mounts the mandrel bar carrying the mandrel, c) feeding the first hollow to the first feed clamping sledge and receiving the first hollow by opening the first feed chuck in the radial direction and clamping the first hollow by closing the first feed chuck in the radial direction, wherein the first feed clamping sledge is at the front point of return of the first feed clamping sledge, and d) milling the first hollow by the rollers over the mandrel into the tube by a milling process that includes stepwise feeding of the first hollow by means of the first feed clamping sledge and an oscillatory back and forth movement of the roll stand between the first roll stand position and the second roll stand position, wherein the first roll stand position corresponds to a front point of return of the roll stand and the second roll stand position corresponds to a rear point of return of the roll stand, the method further comprising, prior to step a), providing the first hollow wound up on a spindle and unwinding the first hollow from the spindle with an unwinding device, wherein the front mandrel thrust block is at a distance from the first feed clamping sledge, measured with the first feed clamping sledge is at the second sledge position, of at least 30 m, and wherein the mandrel bar has a tensile strength of 1000 $N/mm^2$ or more and a strain of 10% or less.

11. The method for manufacturing a tube according to claim 10, wherein the first hollow comprises a length of 30 m or more.

12. The method for manufacturing a tube according to claim 10, wherein the cold pilger rolling mill includes a rear mandrel thrust block with a rear chuck and a second feed clamping sledge with a second feed chuck, wherein the second feed clamping sledge is located behind the first feed clamping sledge in the feed direction of the hollow, and the method further comprises the following step after step a) and prior to step b):

e) opening of the rear chuck of the rear mandrel thrust block in the radial direction and feeding the first hollow through the rear mandrel thrust block, wherein the rear mandrel thrust block is located between the first feed clamping sledge the front mandrel thrust block, wherein the rear mandrel thrust block is at a distance of at least 30 m from the front mandrel thrust block, wherein stepwise feeding the first hollow in step d) further includes moving the first feed clamping sledge between the front point of return of the first feed clamping sledge and the rear point of return of the first feed clamping sledge and moving the second feed clamping sledge between a front point of return of the second feed clamping sledge and a rear point of return of the second feed clamping sledge, wherein the front point of return of the second feed clamping sledge is in front of the rear point of return of the second feed clamping sledge in the feed direction of the hollow, and the method further comprises the steps of:

f) after completely feeding the first hollow through the rear mandrel thrust block, closing the rear chuck of the rear mandrel thrust block in the radial direction such that the rear mandrel thrust block mounts the mandrel bar carrying the mandrel, g) during the milling of the first hollow, unwinding a second hollow, wherein the second hollow is wound on the spindle, wherein the spindle is rotatable around an axis perpendicular to the feed direction, h) opening the chuck of the front mandrel thrust block and feeding the second hollow through the front mandrel thrust block into an area between the front mandrel thrust block and the rear mandrel thrust block, i) after completely feeding the second hollow through the front mandrel thrust block, closing the chuck of the front mandrel thrust block such that the front mandrel thrust block mounts the mandrel bar carrying the mandrel, j) opening the rear chuck of the rear mandrel thrust block, k) feeding the second hollow through the rear mandrel thrust block, l) feeding the second hollow to of the first feed clamping sledge, m) receiving the second hollow and intermittently stepwise advancing the second hollow in the feed direction by means of the first feed clamping sledge and the second feed clamping sledge, n) completely discharging the tube milled of the first hollow from the roll stand and, thereafter, inserting the second hollow into the roll stand, and o) milling the second hollow by the rollers over the mandrel into a second tube by stepwise feeding the second hollow intermittently by means of the first feed clamping sledge and the second feed clamping sledge and the oscillatory back and forth movement of the roll stand.

13. The method for manufacturing a tube according to claim 10, further comprising the steps:

bending a first part of the first hollow in a bending device, wherein the first part of the first hollow is already completely milled, wherein the bending device includes a plurality of bending rollers, and wherein the plurality of bending rollers are pivotably mounted on a mounting frame around a second axis that coincides with a longitudinal axis of the first part of the first hollow as the first part of the first hollow exits a discharge clamping sledge, spirally winding up the first part of the first hollow around a first axis of a winding device, and pivoting the bending device around the second axis, wherein spirally winding up the first part of the first hollow around the first axis of the winding device and simultaneously pivoting the bending device around the second axis, and wherein pivoting the bending device around the second axis occurs synchronously with pivoting of the first hollow around the longitudinal axis of the first hollow during milling of the first hollow.

14. The method for manufacturing a tube according to claim 10, further comprising heating the first hollow to a temperature in a range from 1000° C. to 1200° C. prior to feeding the first hollow through the front mandrel thrust block.

15. A method for manufacturing a finished tube, comprising:

a first manufacturing process in accordance with the method for manufacturing the tube of claim 14, and cold forming the tube manufactured in the first manufacturing process in a second cold pilger rolling mill to form the finished tube.

16. The method for manufacturing a tube according to claim 14, wherein heating the first hollow occurs when the first hollow is wound on the spindle of the unwinding device.

* * * * *